US005151863A

United States Patent [19]

Komuro et al.

[11] Patent Number: 5,151,863

[45] Date of Patent: Sep. 29, 1992

[54] EMBROIDERY PATTERN DATA PROCESSOR HAVING A SEWING ORDER DESIGNATION MECHANISM

[75] Inventors: Kyozi Komuro; Atsuya Hayakawa; Hideaki Shimizu, all of Nagoya, Japan

[73] Assignee: Brother Kogyo Kabushiki Kaisha, Nagoya, Japan

[21] Appl. No.: 552,995

[22] Filed: Jul. 16, 1990

[30] Foreign Application Priority Data

Jul. 19, 1989 [JP] Japan ..... 1-188054

[51] Int. Cl.[5] ..... G06F 15/46

[52] U.S. Cl. ..... 364/470; 112/121.12

[58] Field of Search ..... 364/470; 112/80.23, 112/121.11, 121.12, 103, 455-458

[56] References Cited

U.S. PATENT DOCUMENTS 4,849,902 7/1989 Yokoe et al. ..... 364/470

4,982,674 1/1991 Hayakawa ..... 112/266.1

5,054,408 10/1991 Hayakawa ..... 112/121.12

*Primary Examiner*—Jerry Smith

*Assistant Examiner*—Paul Gordon

*Attorney, Agent, or Firm*—Oliff & Berridge

[57] ABSTRACT

An embroidery pattern data processor for sewing an embroidery based on section data representing the locations of the vertexes of polygonal sections dividing a closed area surrounded by a given outline for embroidering the closed area comprises a memory for storing the section data, a designation means for designating starting and ending points read-out means for reading out the section data, a processor for determining the type of sections, for computing running stitch data, and for computing needle location data for embroidering the sections. The running stitch computing means automatically computes a running stitch route within the sections so that the embroidering operation is carried out without producing cross threads which have previously been manually removed.

19 Claims, 12 Drawing Sheets

FIG. 6

| MEMORY ORDER | SECTION | SECTION DATA |
|---|---|---|
| 1 | a | POINTS 1, 2 |
| | | POINTS 3, 4 |
| 2 | b | POINTS 3, 4 |
| | | POINTS 5, 6 |
| 3 | c | POINTS 5, 6 |
| | | POINTS 7, 8 |
| 4 | d | POINTS 7, 8 |
| | | POINTS 9, 10 |
| 5 | e | POINTS 9, 10 |
| | | POINTS 11, 12 |
| 6 | f | POINTS 11, 12 |
| | | POINTS 13, 14 |
| 7 | g | POINTS 15, 16 |
| | | POINTS 17, 18 |
| 8 | h | POINTS 17, 18 |
| | | POINTS 19, 20 |
| 9 | i | POINTS 19, 20 |
| | | POINTS 21, 22 |
| 10 | j | POINTS 21, 22 |
| | | POINTS 23, 24 |
| 11 | k | POINTS 23, 24 |
| | | POINTS 6, 8 |
| 12 | l | POINTS 5, 7 |
| | | POINTS 25, 26 |
| 13 | m | POINTS 22, 24 |
| | | POINTS 27, 28 |
| 14 | n | POINTS 27, 28 |
| | | POINTS 29, 30 |
| 15 | o | POINTS 29, 30 |
| | | POINTS 31, 32 |
| 16 | p | POINTS 31, 32 |
| | | POINTS 33, 34 |
| 17 | q | POINTS 33, 34 |
| | | POINTS 35, 36 |

FIG. 7

| MEMORY ORDER | SECTION | ADJACENT SECTION | BORDER DATA | BORDER DATA ERASE FLAG | PROCESSED SECTION FLAG | FORK SECTION FLAG | END SECTION FLAG | STARTING POINT | ENDING POINT |
|---|---|---|---|---|---|---|---|---|---|
| 1 | a | b | POINTS 3, 4 | 1 | 1 | | 1 | POINT 1 | |
| 2 | b | a | POINTS 3, 4 | 1 | | | | | |
| | | c | POINTS 5, 6 | | | | | | |
| 3 | c | b | POINTS 5, 6 | | | 1 | | | |
| | | l | POINTS 5, 7 | | | | | | |
| | | k | POINTS 6, 8 | | | | | | |
| | | d | POINTS 7, 8 | 1 | | | | | |
| 4 | d | c | POINTS 7, 8 | 1 | 1 | | | | |
| | | e | POINTS 9, 10 | 1 | | | | | |
| 5 | e | d | POINTS 9, 10 | 1 | 1 | | | | |
| | | f | POINTS 11, 12 | 1 | | | | | |
| 6 | f | e | POINTS 11, 12 | 1 | 1 | | 1 | | |
| 7 | g | h | POINTS 17, 18 | | | | 1 | | |
| 8 | h | g | POINTS 17, 18 | | | | | | |
| | | i | POINTS 19, 20 | | | | | | |
| 9 | i | h | POINTS 19, 20 | | | | | | |
| | | j | POINTS 21, 22 | | | | | | |
| 10 | j | i | POINTS 21, 22 | | | 1 | | | |
| | | m | POINTS 22, 24 | | | | | | |
| | | k | POINTS 23, 24 | | | | | | |
| 11 | k | j | POINTS 23, 24 | | | | | | |
| | | c | POINTS 6, 8 | | | | | | |
| 12 | l | c | POINTS 5, 7 | | | | 1 | | |
| 13 | m | j | POINTS 22, 24 | | | | | | |
| | | n | POINTS 27, 28 | | | | | | |
| 14 | n | m | POINTS 27, 28 | | | | | | |
| | | o | POINTS 29, 30 | | | | | | |
| 15 | o | n | POINTS 29, 30 | | | | | | |
| | | p | POINTS 31, 32 | | | | | | |
| 16 | p | o | POINTS 31, 32 | | | | | | |
| | | q | POINTS 33, 34 | | | | | | |
| 17 | q | p | POINTS 33, 34 | | | | 1 | | POINT 36 |

EMBROIDERY PATTERN DATA PROCESSOR HAVING A SEWING ORDER DESIGNATION MECHANISM

BACKGROUND OF THE INVENTION

1. Field of the Invention

The present invention relates to an embroidery pattern data processor that computes needle locations for sewing each of the sections dividing an embroidery based on section data for designating the locations of the vertexes of the polygonal sections dividing a closed area of a given shape, where the embroidery is defined and surrounded by an outline.

2. Related art

An embroidery pattern data processor of this kind has been disclosed in U.S. Pat. No. 4,849,902.

The conventional technique of processing such data has included the steps of displaying a drawing of embroidery filmed by a television camera or the like on a CRT display unit, storing an outline defining the embroidery in a memory by designating points on the outline with a light pen with the displayed image of the embroidery for reference, drawing dividing lines inside the closed area in any order for dividing the closed area into a plurality of polygonal sections, hence successively defining sections having the designated points as their vertexes, and storing the location data for the vertexes as section data. Then, as well known in the art, the data for needle locations is computed based on section data successively read out and predetermined stitch density data. Embroidery is formed on a cloth by moving the needle and the cloth by relative displacement based on the obtained data for needle locations.

As explained above, the actual embroidering is carried out in accordance with the order in which the section data previously stored in the memory are read out. Therefore, if only section data is stored in the memory, cross threads may occur depending on the order in which the section data are stored. In such cases, it is necessary for the operator to remove all the cross threads after embroidering in order to enhance the esthetic value of the embroidery. Removing cross threads is tedious and labor intensive.

When a plurality of separate closed areas in one embroidery pattern are continuously embroidered without thread-cutting, a starting point and an ending point of each closed area must be properly designated. Otherwise, a cross thread stretching from the ending point of one closed area to the starting point of the next closed area may be sewn in the embroidery of one of the closed areas. Removal of such a cross thread is extremely difficult.

Previously, in order to prevent cross threads from occurring, the operator would designate a starting point and an ending point and anticipate the sewing order in which cross threads do not occur before the step where the operator divides a closed area into a plurality of sections for embroidering the closed area surrounded by a given outline. The operator also prepared section data in accordance with the sewing order. If one section is located separately from the previous section for which the section data has just been prepared, the data for needle locations to form running stitches which run within the sections to the top therethrough are successively prepared. At this point, the section data for sewing the section from the end of the running stitch to the start thereof is prepared. For instance, to form T-shaped embroidery with a point Pl as the starting point and a point P9 as the ending point as shown in FIG. 9, points P1 and P2 are first designated. Second, points P3 and P4 are designated so that a line segment $\overline{P3P4}$ divides the closed area S. Thirdly, the point P4, a point q, and a point P5 are designated for forming running stitches running from the point P4 to the point P5. The location data for the points P4, q, and P5 are stored as the running stitch data. Next, the section data for a section B2 is prepared by designating the point P5, a point P6, the point P3, and the point P4. Likewise, the point P4, a point P7, a point P8, and a point P9 are designated in preparation for the section data for a section B3.

As well known to those skilled in the art, the first two points Pl, P2 are on the side where the embroidering starts while the latter two points P8, P9 are on the side where the embroidering ends. In other words, the running stitches process from the point P4 to the point P5, whereas the embroidering of the section B2 is carried out in the opposite direction from the point P5 to the point P4. This prevents cross threads from occurring.

As is clear from the foregoing explanation, the conventional apparatus necessitates the preparation of section data and running stitch data by the operator, which preparation is difficult, is time-consuming, and requires skill.

SUMMARY OF THE INVENTION

An object of the invention for overcoming the aboveidentified problems is to provide an embroidery pattern data processor having a sewing order designation mechanism which can designate starting and ending points of a closed area, and automatically prepare running stitch data for sewing running stitches within the closed area without producing cross threads and needle location data for embroidering the sections once section data for the sections dividing the closed area is prepared.

To attain this object, an embroidery pattern data processor of the present invention comprises: a memory means for storing section data representing the locations of the vertexes of polygonal sections dividing a closed area for embroidering the closed area; a designation means for designating starting and ending points on the closed area; a read-out means for successively reading out the section data corresponding to each of the given sections starting from the starting section which includes the starting point; a determination means for determining if a section corresponding to the section data read out by the read-out means is an end section of the main section column connected with the starting section, a fork section from which a branch section column branches out of a main section column, or an end section of a branch section column based on the read-out section data; a running stitch computing means for computing running stitch data representing the sewing route of running stitches which run from a fork section to the top of an end section of whichever section column that does not include the ending section between a branch section column and a main section column prior to the embroidering of the fork section if a section corresponding to section data read out by the read-out means is a fork section; and a needle location computing means for computing needle location data for embroidering the sections in the opposite direction from the end of the running stitches toward the fork section based on the section data.

In operation, once section data, which represents the locations of the vertexes of polygonal sections dividing a closed area for embroidery, is stored in the memory means and the designation means designates starting and ending points on a closed area, the read-out means successively reads out the section data corresponding to each of the given sections starting from the starting section which includes the starting point designated by the designation means. Then, the determination means determines, based on the read-out section data, if a section corresponding to the section data read-out by the read-out means is an end section of the main section column connected with the starting section, a fork section from which a branch section column branches out of a main section column, or an end section of a branch section column. The running stitch computing means computes running stitch data representing the sewing route of running stitches which run from a fork section to the top of an end section of whichever section column that does not include the ending point between a branch section column and a main section column prior to the embroidering of the fork section if a section corresponding to section data read out from the memory means is a fork section. Subsequently, the needle location computing means computes needle location data for embroidering the sections in the opposite direction from the end of the running stitches toward the fork section based on the section data.

BRIEF DESCRIPTION OF THE DRAWINGS

FIG. 6 is a memory map describing the section data of the sections of the closed area E.

FIG. 7 is memory map describing the data of the relative positions of the sections of the closed area E.

DETAILED DESCRIPTION OF THE PREFERRED EMBODIMENT

Referring to the attached drawings, the invention embodied in a multi-needle embroidering machine is explained hereinafter.

Figure 2:
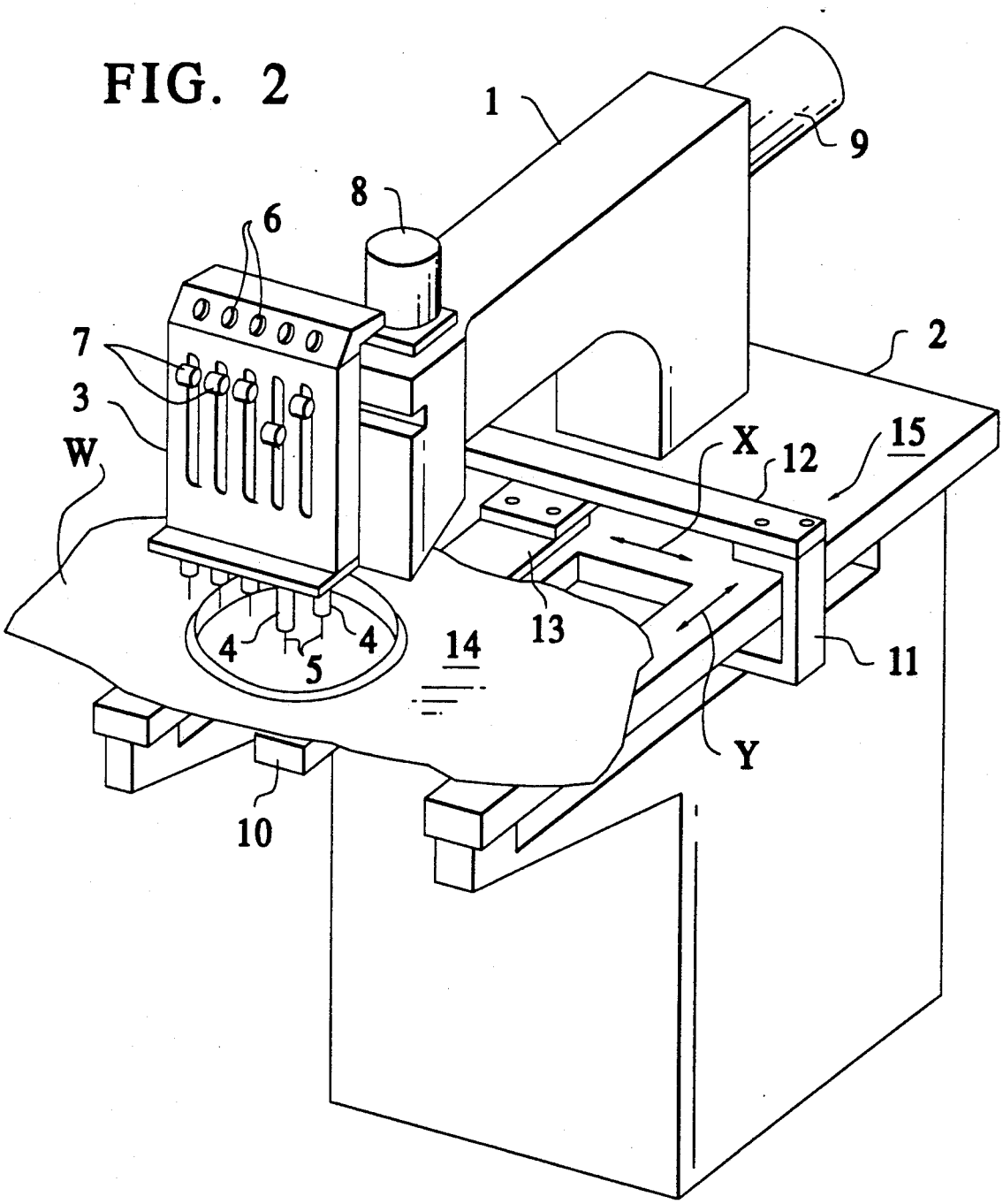
FIG. 2. is a perspective view of a multi-needle embroidery machine embodying the invention.
Figure 3A:
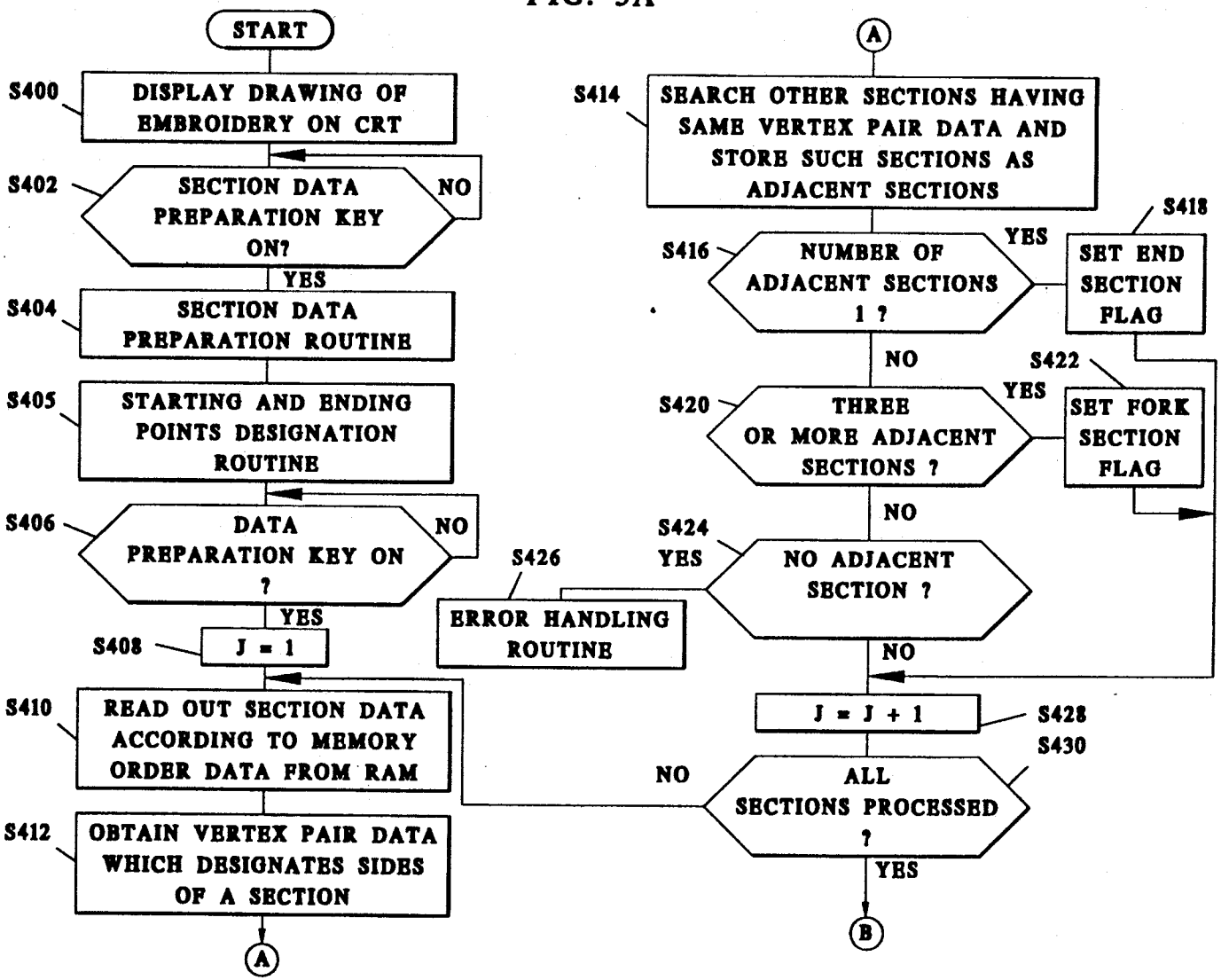
FIGS. 3A-3B are flowcharts describing the main operations of the Central Processing Unit of the embodiment.
Figure 3B:
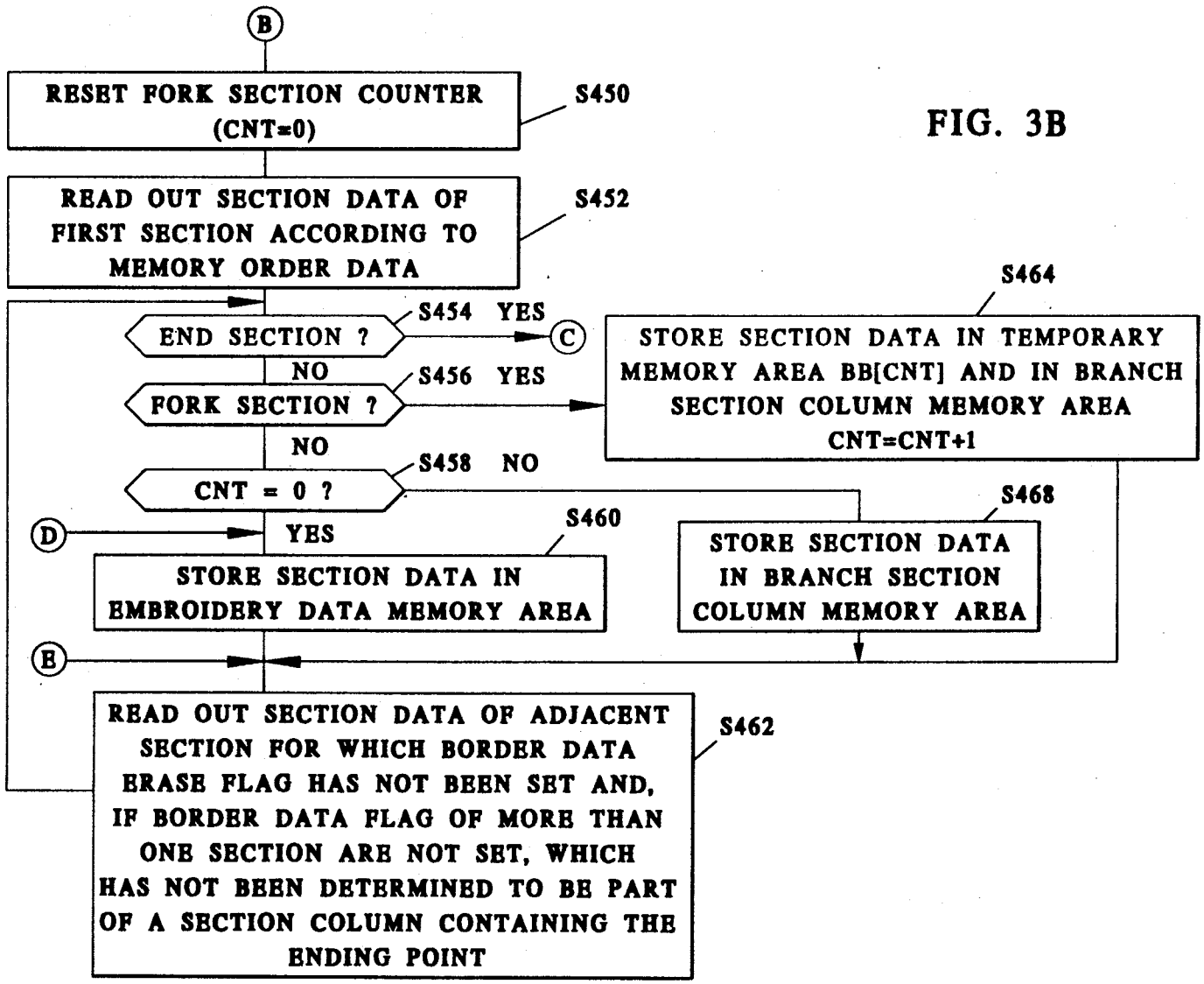
Figure 3C:
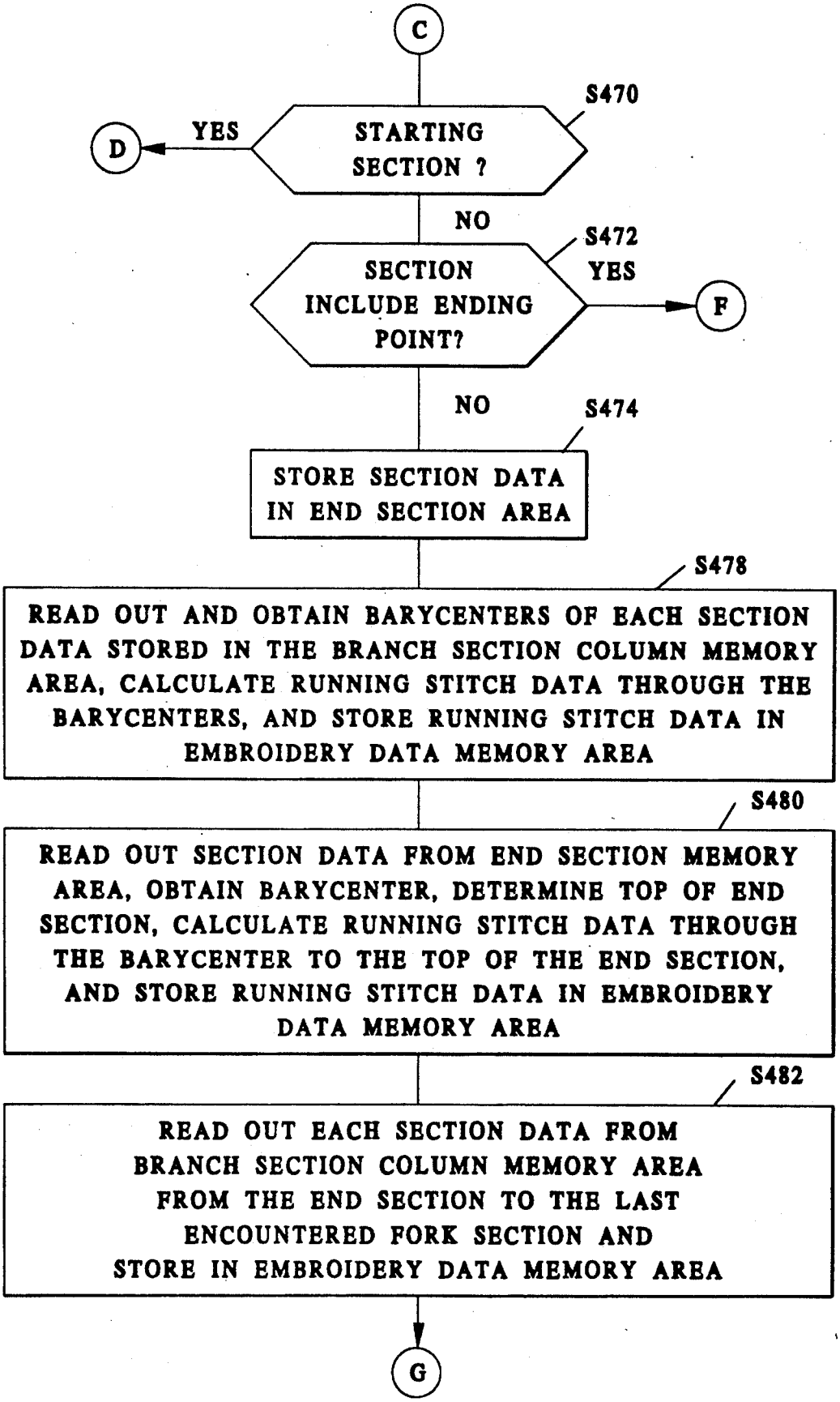
Figure 3D:
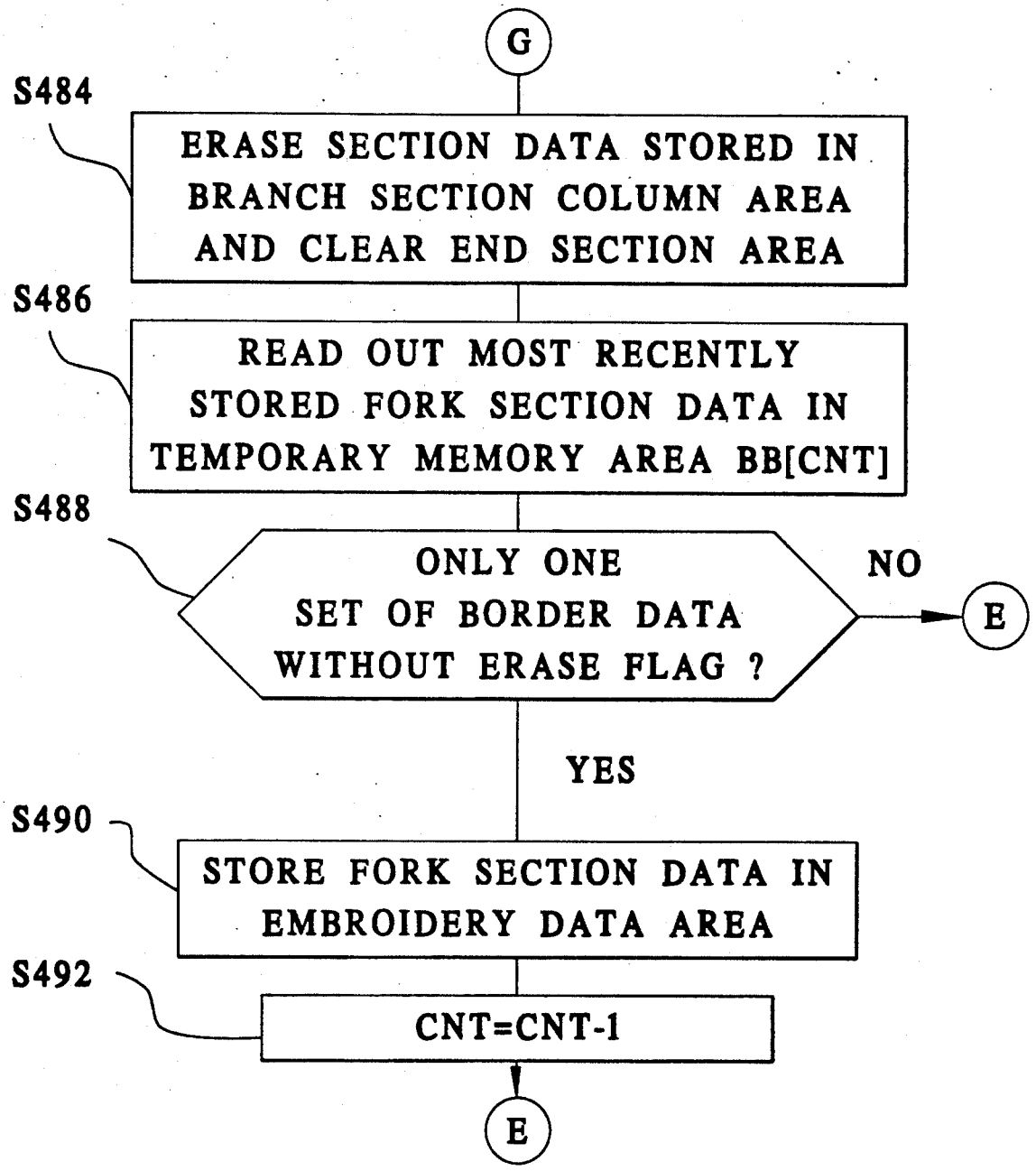
Figure 3E:
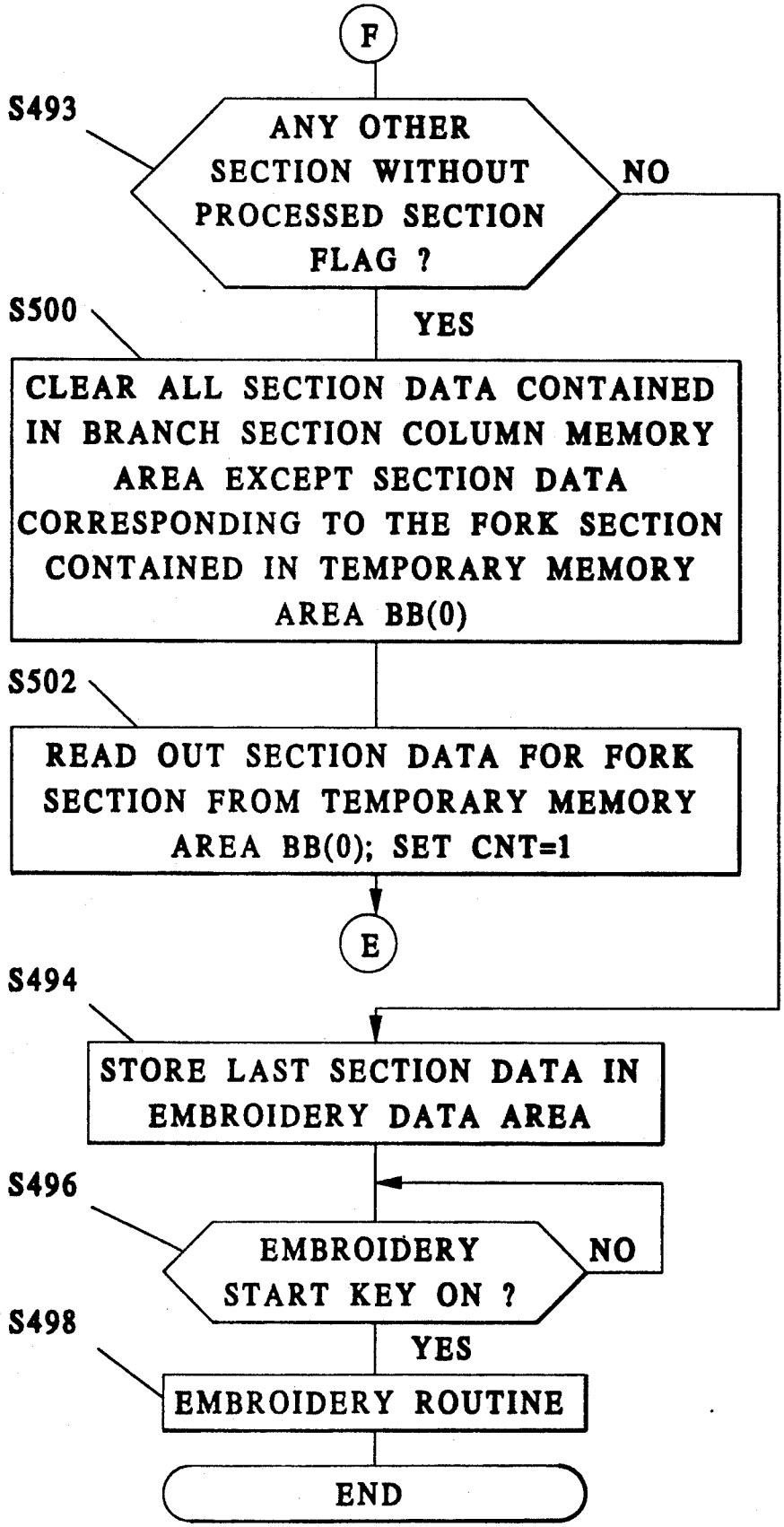

As illustrated in FIG. 2, an arm 1 is mounted on a table 2. A needle bar support case 3 is movably supported in the directions indicated by an arrow X on the top end of the arm 1. Four needle bars 4 are respectively supported by the needle bar support case 3 so that the needle bars 4 are vertically movable. Needles 5 are detachably mounted on the lower ends of each of the needle bar 4. Various types of threads are supplied to the needles 5 from a thread supply source (not shown) via thread tension adjusters 6 and thread take-up levers 7 provided on the needle bar support case 3. A needle selection motor 8 is provided on the arm 1 and is drivably connected to the needle bar support case 3. When a predetermined needle selection signal is input into the needle selection motor 8, the needle selection motor 8 moves the needle bar support case 3 to put one of the needles 5 in a designated position.

Provided at the rear of the arm 1 is a sewing motor 9 whose power is transmitted to the positioned needle bar 4 via a power transmission mechanism (not shown), thereby vertically moving the needle bar 4. A bed 10 projects from the table 2 and is positioned so that it is opposed to the needle bar 4. The bed 10 is provided with a loop capture device therein for forming stitches on a work W in cooperation with the needle 5. The needle 5, the loop capture device, and so forth compose a stitch forming means.

A pair of Y-direction movable frames 11 (referred to as first movable frames hereinafter) are provided at both sides of the table 2 so that the first movable frames 11 can slide in the directions indicated by an arrow Y. The first movable frames 11 are driven by a not-shown Y-direction drive motor (referred to as first drive motor hereinafter). FIG. 2 shows only one of the first movable frames 11. Further, the first movable frames 11 are connected with each other via a supporting beam 12 provided therebetween. The bottom end of a X-direction movable frame 13 (referred to as second movable frame hereinafter) is supported by the supporting beam 12 so that the second movable frame 13 can slide in the directions indicated by an arrow X along the supporting beam 12. The second movable frame 13 is driven by a not-shown X-direction drive motor (referred to as second drive motor hereinafter). A support ring 14 provided as a support means is mounted on the second movable frame 13 for releasably supporting the work W.

The first and second movable frames 11 and 13, the support beam 12, and the first and second drive motors compose a feed device 15 for changing the relative position of the support ring 14 and the needle 5 in synchronization with the vertical motion of the needle 5. Stitches of embroidery are formed on the work W by the relative displacement movement of the support ring 14 and the needle 5.

The electrical composition of the embodiment is explained hereinafter.

Figure 1:
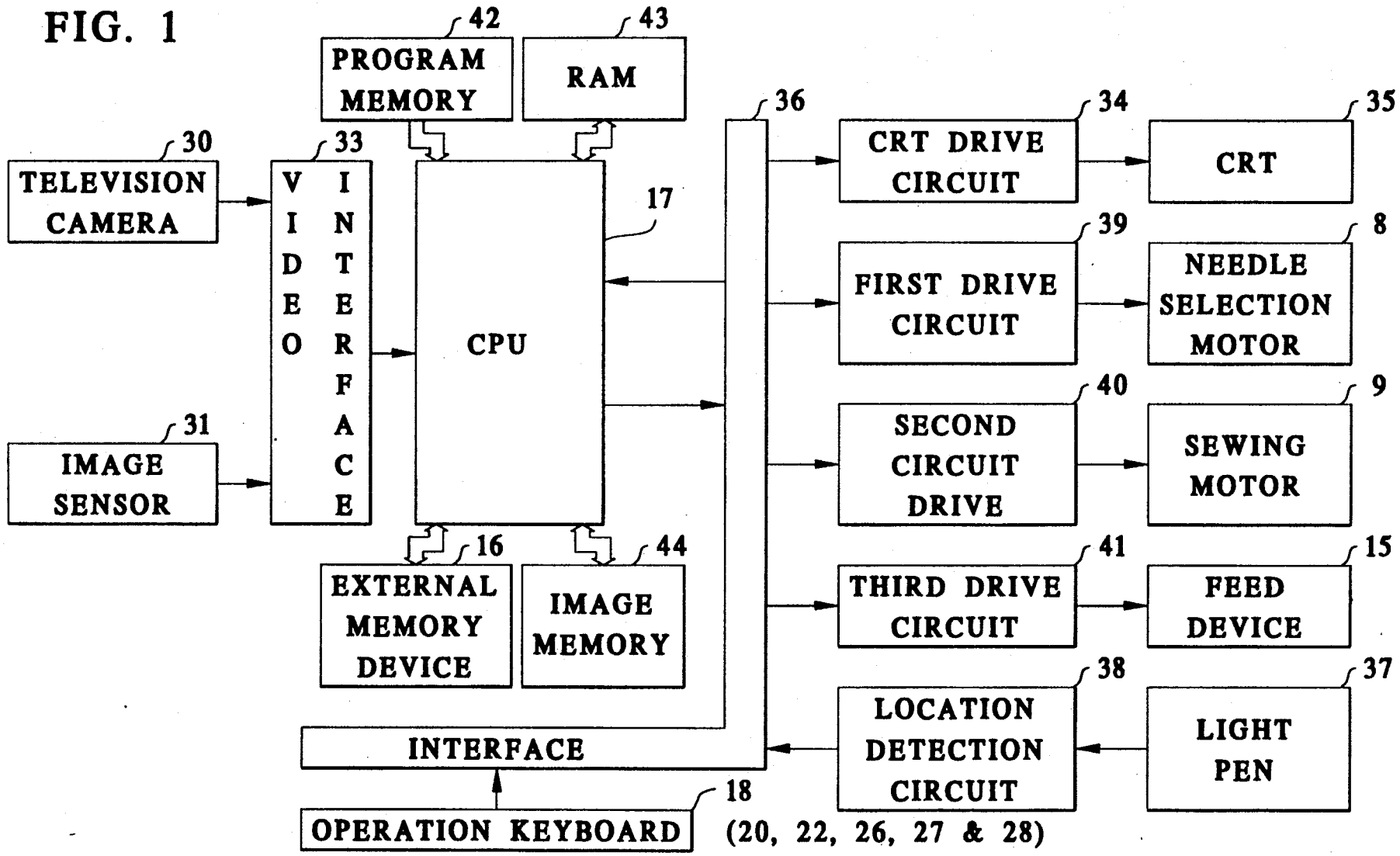
FIG. 1 is a block diagram of electric circuit embodying the present invention.

As shown in FIG. 1, an operation keyboard 18 is connected to an interface 36 of a CPU 17. The operation keyboard 18 is provided with a data preparation key 20, a section data preparation key 22, an embroidering start key 26, a starting point input key 27, and an ending point input key 28. The needle selection motor 8, the sewing motor 9, and a feed device 15 are connected to the interface 36 via a first, second, and third drive circuits 39, 40, and 41, respectively. Further, a CRT 35 is connected to the interface 36 via a CRT drive circuit 34 while a light pen 37 is provided for designating given points on the display surface of the CRT 35 via a location detection circuit 38. The CPU 17 is connected with a television camera 30, for filming a drawing of an embroidery, and an image sensor 31 via a video interface 33. The CPU 17 is also connected with a program memory 42 which contains its motion programs, a RAM 43 chiefly composing a memory means for storing section data, an external memory device 16 for storing needle location data, and an image memory 44 for storing a drawing of the embroidery filmed by the television camera 30 or the like, or the location data of the points on the display surface of the CRT 37 designated by the light pen 37.

Figure 4:
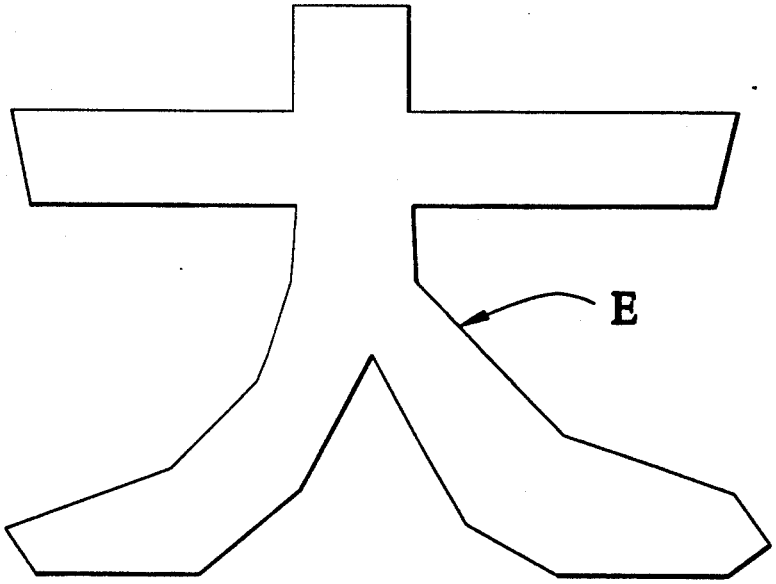
FIG. 4 is a closed area E of the embodiment.

The embroidery operation on a closed area E shown in FIG. 4 is explained, referring to the flowcharts shown in FIGS. 3A-3E. In this case, the inside of the closed area E is embroidered.

Figure 5:
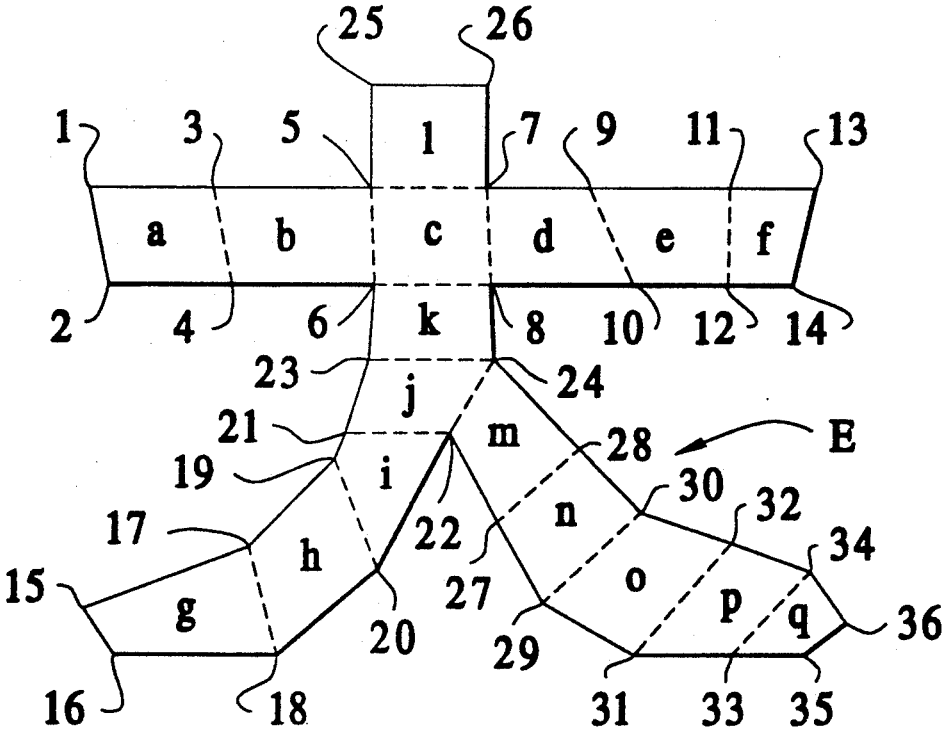
FIG. 5 is the closed area E divided into sections.

When the power supply is switched on after a drawing of the embroidery of the closed area E is set in the filming zone of the television camera 30 or the image sensor 31, the CPU 17 films and displays the drawing of the embroidery on the CRT 35 at step S400. When the section data preparation key 22 is switched on by the operator at step S402, the process goes on to a section data preparation routine at step S404. In this routine, after the outline of the closed area E is stored using the light pen 37, dividing points for dividing the outline are successively designated by the light pen 37, hence dividing the closed area E into a plurality of polygonal sections. The dividing points represent the vertexes of the sections and the location data of the vertexes are stored in the RAM 43 as the section data for each section. The closed area E, for example, is divided into sections a-q as illustrated in FIG. 5 and the section data for each section is shown in the memory map in FIG. 6. Points 1-4 of the section a are stored in the numerical order, wherein the first two points 1 and 2 indicate the two vertex needle locations on the starting side of the section a. Therefore, the starting stitches are formed between points 1 and 2. Likewise, the latter two points, points 3 and 4, indicate the two vertex needle locations on the ending side of the section a. The ending stitches are formed between points 3 and 4.

The light-penned division of a closed area is not given detailed explanation herein since it is included in U.S. Pat. No. 4,849,902 in the name of the present applicant.

It should be noted, however, that the sections are stored in the RAM 43 in arbitrary order without considering an embroidering order of the sections. While all the sections shown in FIG. 5 are quadrangle, triangles or other types of polygons will also suffice. A section may include arcs. If a section is a triangle or some other polygon wherein embroidering either starts or ends at one point, the data for the two vertexes representing such point is the same when stored. In case of a pentagon or other polygons having five or more vertexes, the data for designating the remaining sides, other than the above four points, is stored for each section.

After finishing the preparation of the section data, the CPU 17 goes to a designation routine in which starting and ending points for embroidering a closed area is designated at step S405. In this routine, the operator designates a desired point on the CRT 35 using the light pen 37 and switches on the starting point input key 27. Subsequently, the CPU 17 detects the location of the designated point and stores the location data as a starting point in the RAM 43. In the present embodiment, a vertex of an end portion of a closed area ( the top of an end section) is designated as a starting point. As shown in FIG. 7, a point 1 is designated as a starting point. Then, using the light pen 37 the operator designates a vertex of the top of any end section among the sections dividing a closed area on the CRT 35 other than the starting section which includes the starting point, and switches on the ending point input key 28. Now, the CPU 17 stores the location data of the designated point as an ending point in the RAM 43. As shown in FIG. 7, a point P36 is stored as the ending point. Once starting and ending points of each of the given closed areas are stored, the CPU 17 waits for the data preparation key 20 to be switched on at step S406. When it is switched on, the CPU 17 reads out the section data for a section from the RAM 43 in the memory order data J (J=1,2,3, . . .) at step S410.

Based on the read-out section data, the CPU 17 obtains the data for all the pairs of vertexes (referred to as vertex pair data hereinafter) which designates the sides of a section at step S412. For instance, the vertex pair data for section a includes pairs of points 1 and 2, points 3 and 4, points 1 and 3, and points 2 and 4.

Next, the CPU 17 searches the RAM 43 for other sections which have the same vertex pair data of the section data as that of the read-out section and stores the names of the searched sections as adjacent sections along with the vertex pair data in a predetermined memory area of the RAM 43 at step S414. Vertex pair data dividing two adjacent sections is referred to as border data hereinafter.

When the search for all the adjacent sections to every side of the section read out at step S410 is finished, the CPU 17 counts the number of the adjacent sections and determines if it is one at step S416. If it is one, the CPU 17 judges that the section read out at step S410 is an end section located at an end of the closed area E and sets an end section flag in a predetermined memory area in the RAM 43 at step S418.

As shown in the memory map of FIG. 7, the RAM 43 contains a main memory area storing for each section memory order data, adjacent section names, border data, a border data erase flag, a processed section flag, a fork section flag (explained below), an end section flag starting point data, and ending point data.

If it is determined that a given section has three or more adjacent sections at step S420, the CPU 17 decides that a column of sections branches out from another column of sections and the section read out at step S410 is a fork section from which a column of sections branches and for which the CPU 17 sets a fork section flag at step S422. If it is determined that a section has no adjacent section at step S424, an error handling routine is carried out at step S426 because there is no adjacent section. If a given section has two adjacent sections, the CPU 17 decides that the given section is an ordinary, non-fork section located between two other sections in a section column. The CPU 17 carries out the process from steps S410 to S426 on all the sections at steps S428 and S430. Therefore, when the closed area E is divided into sections by the section data as shown in FIG. 5, end section flags are set for the sections a, f, l, g, and q,while fork section flags are set for the sections c and j as shown in FIG. 7.

Figure 8:
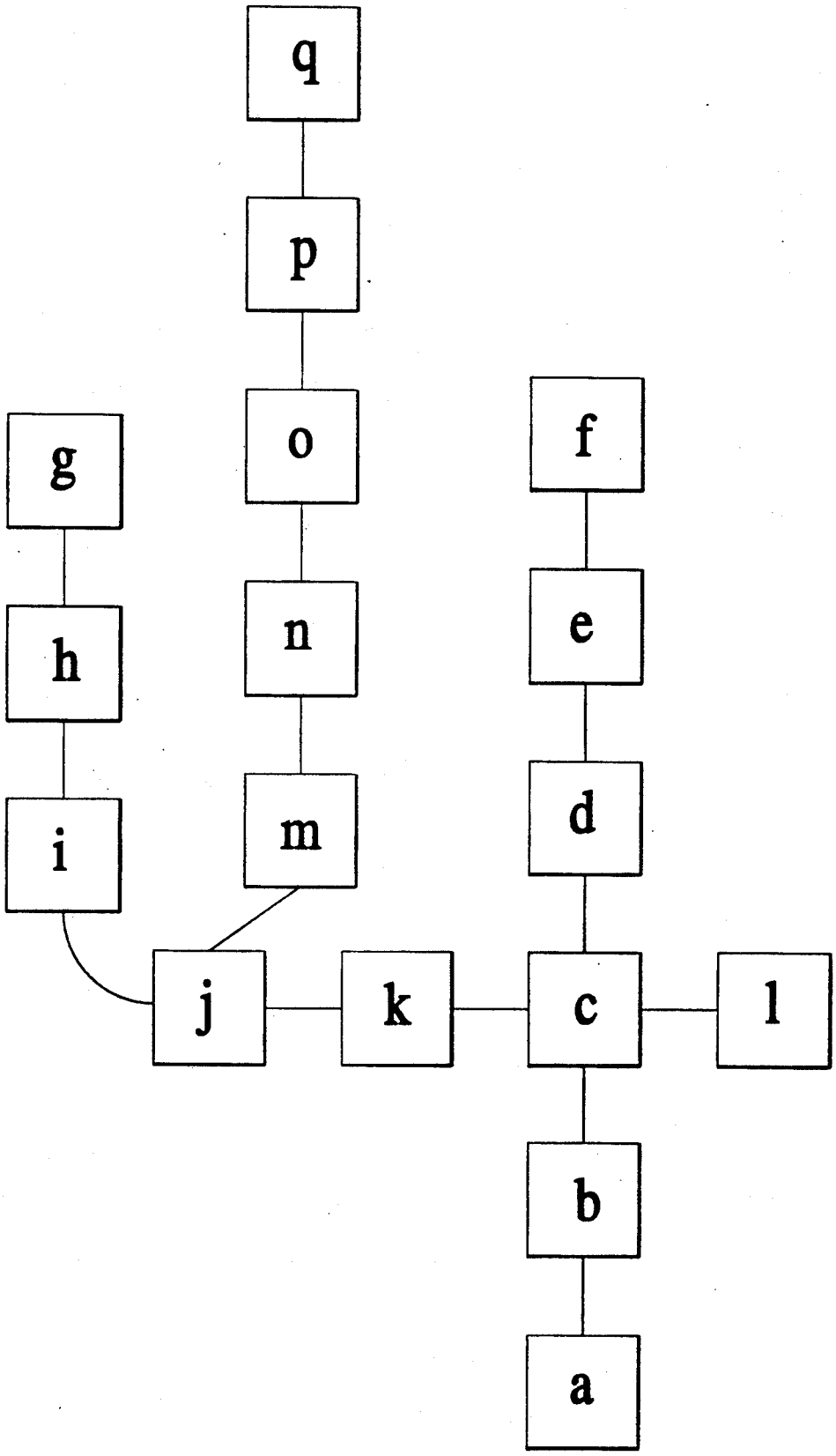
FIG. 8 is an explanatory view indicating the relative positions of the sections of the closed area E.
Figure 9:
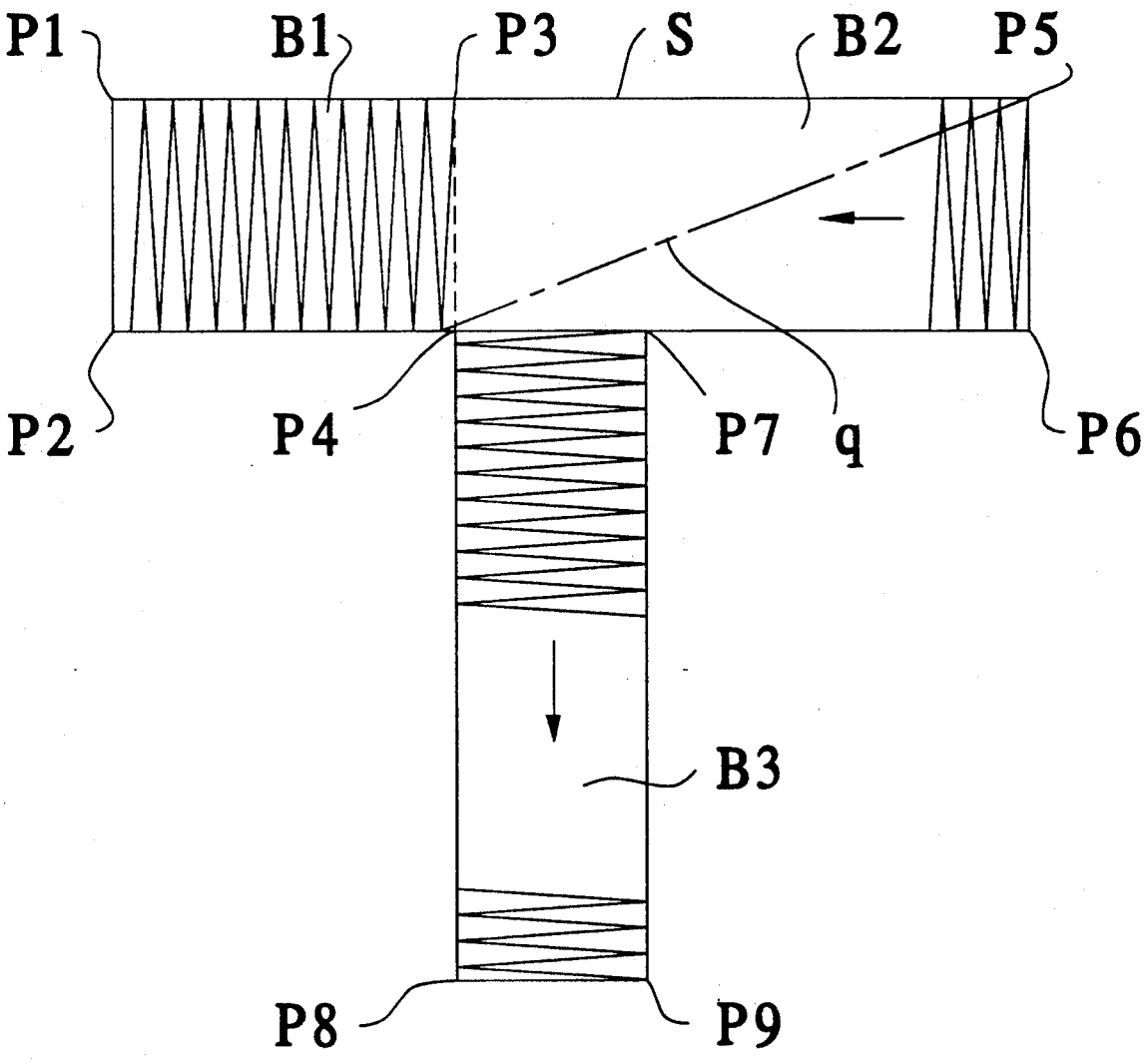
FIG. 9 PRIOR ART
FIG. 9 is an explanatory view indicating manual sectioning of a character T and the processing of the running stitch data in the prior-art apparatus.

As shown in FIG. 8, the obtained adjacent section data represents the relative position of the sections. FIG. 8 shows the relative position of each section to the section a, which is the starting section that includes the starting point. A group of sections which share section data on starting sides or ending sides forms a section column. The section column stretching from the section a is a main section column which consists of the sections a-f. The sections a and f are called end sections of the main section column. A column of sections branching out of a main section column is called a branch section column. The section columns branching out from the main section column at the section c are branch section columns. The section c at which the two columns branch out is called a fork section. Another branch section column m-n-o-p-q branches out of the branch section column k-j-i-h-g at the section j. The sections l, g, and q are the end sections of the branch section columns.

Next, the CPU 17 resets a fork section counter CNT at step S450, reads out the section data of the starting section, the section a from the RAM 43, and stores the embroidering direction of the read-out section a at step S452.

If the CPU 17 determines that a read-out section is not an end section in a determination routine at step S454, that the read-out section is not a fork section in a determination routine at step S456, and that the value of the fork section counter CNT is zero in a determination routine at step S458, then the CPU 17 stores the section data in an embroidery data memory area at step S460. Every time section data is stored in the embroidery data memory area, a processed section flag is set for the sections represented by the section data. At the same step, the CPU 17 sets an erase flag for the border data of the sections for which the processed section flag is set. Border data is expressed as vertex pair data. As an example, when a processed section flag is set for the section a, an erase flag is set for the border data consisting of points 3 and 4.

At step S460, before storing section data in the embroidery data memory area, the CPU 17 searches for an adjacent section whose section data has already been stored in the embroidery data memory area. If found, the CPU 17 determines if the ending side vertex pair data of the adjacent section are the same as the starting side vertex pair data of the read-out section. If not found the CPU 17 exchanges the starting side vertex pair data with the ending side vertex pair data before storing the data.

The CPU 17 now searches the adjacent sections to the sections which are stored at step S460 for adjacent sections without a border data erase flag. Then, the CPU 17 reads out the section data of such adjacent sections and goes back to step S454 at step S462. If YES at step 454, the process goes to step S470. The CPU 17 determines if the read-out section is a starting section at step S470. If YES at step S470, the process goes back to step S460. If NO at step S470, the process goes to step S472. If it is determined YES at step S456, in other words, if the section is a fork section, the process goes to step S464 where the CPU 17 stores the section data of the section in a temporary memory area BB (CNT) provided in the RAM 43 for temporarily storing such data and in a branch section column memory area and increments the fork section counter CNT. The process then goes to step S462.

Therefore, if a section read out at step S462 is neither an end section nor a fork section, step S458 is NO and the read-out section data is successively stored in the branch section column memory area provided in the RAM 43 at step S468, and the process then goes to step S462.

On the other hand, if the section according to the section data read out at step S462 is an end section, step S454 is YES and the CPU 17 goes to step S470. If the section is not a starting section which is the first section to be read out, then step S470 is NO. Then, it is determined if the section is the last section which includes the ending point at step S472. If step S472 is NO, the section data is stored in an end section memory area at step S474.

Now the CPU 17 successively reads out the section data from the branch section column memory area in the order indicated by the memory order data, obtains the barycenter qi ($i=0, 1, \ldots, n-1$) of each section, and stores its location data and a needle location data flag in the embroidery data memory area at step S478.

After that, the CPU 17 reads out the section data from the end section memory area, obtains the barycenter qn, designates the top of the end section as a running stitch end r and stores the running stitch location data in the embroidery data memory area at step S480. The running stitch end r is a vertex not stored as border data. The barycenters qo, ql, . . . ,qn and the running stitch end r compose running stitch data which designates the route of running stitches running from a fork section to the top of an end section.

Next, the CPU 17 reads out the section data of the sections most recently stored in the temporary memory area BB [CNT]. To embroider the sections from the end section to the adjacent section in the opposite direction, the CPU starts reading section data from the end section where the running stitch end r ends to the section which is adjacent to the fork section and is on the same side as the running stitch end r. In other words, the CPU 17 reads section data in the opposite direction to that of the running stitch r. The CPU 17 also stores the above read-out section data of each section at step S482. The CPU 17 compares the embroidering direction of each section of the read-out sections with the above-defined opposite direction. If the two directions are not the same, the CPU 17 exchanges the starting side data of the section with the ending side data of the section.

When the end section through the section adjacent to the most recently stored fork section have been stored in the embroidery data memory area as explained above, processed section flags and border flags for border data represented by vertex data are set for the branch column sections, as shown in the memory map of FIG. 7.

Meanwhile, the CPU 17 erases the section data of the sections stored in the branch section column memory area, because the section data is stored in the embroidery data memory areas, and clears the end section memory area at step S484. Then, the CPU 17 again reads out the section data of the fork section most recently stored in the temporary memory area BB [CNU] at step S486 and determines if there is only one set of border data for which an erase flag is not set among the border data of the adjacent sections to the most recently stored fork section at step S488. In other words, the CPU 17 determines if the remaining unprocessed part in the closed area will not be divided if the fork section is embroidered. If it is determined NO at this step, the embroidering of the fork section is judged impossible as it is. Then, the process goes back to step S462 where the CPU 17 selects border data of one adjacent section for which an erase flag is not set, reads out from the RAM 43 the section data of the second having the vertexes represented by the border data, and repeats the process explained above.

In this way, section data is successively stored in the branch section column memory area. When section data for an end section is read out, step S454 is YES and the process goes to step S470. Since this end section is not the starting section, step S470 is NO. Then, it is determined if the end section is the last section which includes the ending point at step S472. If step S472 is YES, the CPU 17 determines at step S493 whether there is any section for which a processed section flag is not set other than the last section processed. If step S493 is YES, at step S500 the CPU 17 clears the readout section data of the last section and also clears, among the section data stored in the fork section column memory area, the section data for the sections from the last section stored to the section which is stored immediately after the fork section in the temporary memory area BB (0). Subsequently, CNT is set to 1, and the CPU 17 reads out the section data for the fork section (the section c) from the temporary memory area BB (0) at step S502 and goes back to step S462.

As an example, it is now presumed that the section data for the sections a and b has been stored in the embroidery data memory area. Further, it is presumed that the running stitch data from the section c to the top of the section f has been prepared and the section data for embroidering from the section f to the section d in the opposite direction has been stored in the embroidery data memory area, with or without modification.

If, of the two sections k and l adjacent to the section c, the section data for section k is read out, the section data for the section q (the last section) will be read out after the section data for the sections j, m, n, o, and p is successively stored in the fork section column memory area. Step S943 is YES because the sections, l, i, h, and g are not stored in the fork section column memory area and are not yet given processed section flags. Then, the section data for the sections q, p, o, n, m, j, and k are erased from the fork section column memory area at step S500. At steps S502 and S462, the section data for the section l is read out because the process determined that the branched section column extending from section k contains the ending section. After the running stitch data for stitching to the top of the section l is prepared at steps S454, S470, and S474-S486, the section data for the section l is stored in the embroidery data memory area with or without modification so that the section l is embroidered in the opposite direction.

On the other hand, if step S488 is YES, the fork section corresponding to the fork section data may embroider and the fork section data is stored in the embroidery data memory area at step S490. At this moment, the data processing of one adjacent section to either the starting side or the ending side of the fork section has been completed. The CPU 17 now determines if the embroidering direction of the adjacent section is the same as that of the fork section. If YES, the fork section data is stored in the embroidery data memory area. If NO, the CPU 17 exchanges the starting side data of the fork section with the ending side data of the fork section and stores the data in the embroidery data memory area. Meanwhile, a processed section flag and a border data erase flag are set.

Next, the CPU 17 decrements the fork section counter CNT at step S492 and goes back to step S462. At this step S462, the CPU 17 reads out a section which is adjacent to the fork section and for which a processed section flag is not set, and repeats the process from step S454.

When the section data of each section and the running stitch data is stored in the embroidery data memory area and the last section is read out at step S462, steps S454 and S472 are YES and step S493 is NO. Then, the CPU 17 stores the section data of the last section in the embroidery data memory area at step S494.

Likewise at this step, the section data is modified, if necessary, and stored so that the embroidering direction of the last section is the same as that of the second last section which is stored in the embroidery data memory area immediately before the last section.

After that, the CPU 17 waist for the embroidery start key 26 to be switched on at step S496. Upon switching on the embroidery start key 26, the process goes to the embroidery routine at step S498 where an embroidery pattern is formed on the work W by moving the needle 5 and the support ring 14 by relative displacement based upon the section data and the running stitch data successively read out from the embroidery data memory area. During this operation, no cross threads occur.

After section data is read out, needle location data is computed based upon the stitch density data and the section data, as is well known in the art.

While the described embodiment represent the preferred form of the invention, it si to be understood that changes and variations can be made without departing from the spirit and the scope of the invention.

For instance, the operator manually inputs the section data which is first stored in the memory means in the described embodiment. However, it is possible to detect the outline of an embroidery automatically after filming a drawing of the embroidery and automatically compute the section data based upon the outline data using an operational program.

Although running stitch data for running stitches comprises needle location data in the present embodiment, it could be expressed in a functional formula which expresses a running stitch route.

Also in the present embodiment, in order to perform embroidery from the top of an end section toward a fork section in the direction opposite to that of the running stitches, the embroidering direction of each section is compared with the opposite direction. If the embroidering direction and the opposite direction are the same, the section data of the section is stored in the embroidery data memory area. If not, the CPU exchanges the starting side data of the section with the ending side data of the section. During actual embroidering, the needle location data is computed based upon the predetermined stitch density and the section data which may or may not have been modified. The following is another method of embroidering the sections from the top of the running stitches toward the fork section in the opposite direction.

When the section data is read out by the read-out means, the needle location data is computed based upon the stitch density data and the read-out section data. At the same time, the embroidering direction is computed and temporarily stored. After the running stitch data is prepared, the direction opposite to that of the running stitches is compared with the computed embroidering direction of the needle location data in order to execute the embroidering of each section in the opposite direction. If the two directions are the same, the above needle location data is stored in the embroidery data memory area in the same order as it has been processed. If not, the order of the above needle location data is reversed before it is stored in the embroidery data memory area.

Although starting and ending points are designated at end-side vertexes of any end sections in the present embodiment, it is possible to designate vertexes of sections other than end sections. In such cases, the running stitch data for stitching from the starting point of the starting section to an end-side vertex of the end section included in the starting section column is prepared. If the last section is not an end section, the running stitch data for stitching from the last section to an end-side vertex of the end section included in the last section column is prepared. After that, the section data for each of the sections are stored in the embroidery data memory area with or without modification so that embroidery is carried out from the end side of the end section to the last section in the opposite direction.

As described above in detail, according to the present invention, the memory means stores section data for the vertexes of polygonal sections dividing a closed area for embroidering the closed area, the designation means designates starting and ending points on a closed area, and the read-out means successively reads out the section data corresponding to each of the given sections starting from the starting section including the starting point. Then, the determination means determines if a section corresponding to the section data read-out by the read-out means is an end section of the main section column connected with the starting section, a fork section from which a branch section column branches out of a main section column, or an end section of a branch section column based on the read-out section data. The running stitch computing means computes running stitch data representing the sewing route of running stitches which run from a fork section to the top of an end section of whichever section column that does not include the ending point designated by the designation means between a branch section column and a main section column prior to the embroidering of the fork section if a section corresponding to section data read out by the read-out means is a fork section. Subsequently, the needle location computing means computes needle location data for embroidering the sections in the opposite direction from the end of the running stitches toward the fork section based on the section data.

In the present invention, if only the section data for the sections dividing a closed area is prepared, running stitches which run within the closed area are automatically prepared and the needle location data for embroidering from the top of the running stitches in the opposite direction to that of the running stitches is also automatically processed so that the embroidery starts at a designated point and ends at a designated point. In this way, cross threads do not occur. Therefore, the operator does not have to consider embroidering order during running stitch data processing or sectioning of the closed area. Thus, the embroidery sewing processor of the present invention has the advantage that it saves time and allows even an unskilled operator to process embroidery pattern data easily.

What is claimed is:

1. An embroidery pattern data processor for a sewing machine that sews, under control of needle location data, an embroidery pattern comprising at least one closed area, comprising:

section data memory means for storing section data representing sections into which outlines representing the at least one closed area are divided;

designation means for designating a starting section and an ending section for each of the at least one closed areas; and needle location computing means for computing needle location data so that the sewing machine embroiders the ending section of each closed area after embroidering all other sections of the closed area by determining, when the needle location computing means computes data for a given ending section, whether any other sections of the closed area containing the given ending section exist for which the needle location data computing means has not computed needle location data.

2. The embroidery pattern data processor claim 1, further comprising determination means for determining whether each of the section sin the at least one closed area is an end section adjacent to only one other section or a fork section adjacent to more than two other sections.

3. The embroidery pattern data processor of claim 2, in which:

each closed area contains a main section column, where the main section column comprises a column of sections between the starting section and the ending section, inclusive;

each closed area containing a fork section contains a branch section column, where a branch section column is a column of sections between a fork section and end sections that are not part of the main section column, inclusive of the ending sections not included in the main section column; and needle location computing means computes needle location data for branch section columns before computing needle location data for the main section column.

4. The embroidery pattern data processor of claim 3, in which, if the ending section is not an end section, the main section column further comprises the column of sections between the ending section and an opposing end section, that is one an opposite side of the ending section from the starting section, inclusive; wherein the needle location computing means computes needle location data such that the sewing machine embroiders the part of the main section column between the starting section and the ending section from the starting section towards the ending section; and the needle location computing means computes needle location data such that the sewing machine embroiders the part of the main section column between the opposing end section and the ending section from the opposing end section towards the ending section.

5. The embroidery pattern data processor of claim 3, in which the needle location computing means computes needle location data such that the sewing machine embroiders main section columns from starting sections towards the ending sections and embroiders branch section columns from end sections towards fork sections.

6. The embroidery pattern data processor of claim 5, in which:

a fork section that is part of a main section column is a main fork section and a fork section that is part of a branch section column is a branch fork section; and the needle location computing means computes needle location data such that the sewing machine embroiders branch section columns from branch fork sections towards main fork sections.

7. The embroidery pattern data processor of claim 6, in which the needle location computing means further comprises:

running stitch data computing means for computing running stitches in branch section columns from fork sections towards end sections; and embroidery stitch data computing means for computing embroidery stitches for embroidering the at least one closed area.

8. The embroidery pattern data processor of claim 2, further comprising:

read-out means for reading out the section data stored in the section data memory means for processing by the needle location computing means, where the read-out means begins by reading out section data corresponding to a starting section and then reads out one section that is adjacent to the last section processed by the needle location computing means and that has not been processed by the needle location computing means; wherein section data is processed when the needle location computing means computes needle location data for the section associated with that section data.

9. The embroidery pattern data processor of claim 8, further comprising:

branch section column memory means for temporarily storing section data during processing by the needle location computing means; wherein when the read-out means reads out a fork section for processing by the needle location computing means, the needle location computing means stores the section data representing the fork section in the branch section column memory means and the read-out means reads out for processing section data of other sections until only one section adjacent to the fork section has not been processed, at which time the needle location computing means processes the fork section before the read-out means reads out the last unprocessed section adjacent to the fork section.

10. The embroidery pattern data processor of claim 9, in which, after the read-out means reads out a given fork section, the read-out means consecutively reads out and the needle location computing means stores in the branch section column memory means adjacent unprocessed sections until the needle location computing means determines that the read-out means has read out an end section, at which point:

if the read-out means has read out an ending section of a given closed area and the section data memory means contains unprocessed section data for the given closed area, the needle location computing means erases section data stored in the branch section column memory means and the read-out means reads out section data of an unprocessed section that is adjacent to the given fork section and, unless only one unprocessed section is adjacent to the first stored fork section, that has not been determined to be part of a column of sections containing the ending point; and if the read out means has read out an end section that is not an ending section, the needle location computing means computes needle location data for the section data stored in the branch section column memory means.

11. The embroidery pattern data processor of claim 10, in which the needle location computing means further comprises:

running stitch data computing means for computing running stitch needle location data from fork sections to end sections that are not the ending sections; and embroidery stitch data computing means for computing embroidery stitch needle location data for embroidering the closed areas, where the embroidery stitch data computing means computes embroidery stitch needle data such that the sewing machine embroiders from end sections that are not ending sections to fork sections and from starting sections to ending sections.

12. The embroidery pattern data processor of claim 1 further comprising:

fork section memory means for storing the section data associated with fork sections that have been read out by the read-out means but which have not been processed by the needle location computing means; wherein if the read-out means has read out an end section that is an ending section and the section data memory contains unprocessed section data, the needle location computing means erases the section data stored in the branch section column memory area and in the fork section memory means except for the section data corresponding to the fork section first stored in the fork section memory means, and the read-out means reads out section data of an unprocessed section that is adjacent to the first stored fork section and, unless only one unprocessed section is adjacent to the first stored fork section, that has not been determined to be part of a column of sections containing the end point.

13. The embroidery pattern data processor of claim 1, in which the needle location computing means computes needle location data such that the sewing machine forms a stitch from the ending section of one closed area to the starting section of the next adjacent, unconnected closed area of the embroidery pattern.

14. An embroidery pattern data processor for generating needle location data for a sewing machine that sews embroidery patterns under control of the needle location data, the needle location data for an embroidery pattern being generated based on a plurality of sections formed by dividing closed areas defined by an outline representing the embroidery pattern to be stitched by the sewing machine, comprising:

section data memory means for storing section data representing the plurality of sections dividing the closed areas;

determination means for determining whether each section data in the section data memory means corresponds to a fork section connected to more than two sections or an end section connected to only one section;

designation means for designating starting and ending points for each closed area, where the sections containing the starting and ending points are a starting section and an ending section, respectively, and a column of sections between the starting and ending sections is a main section column;

temporary memory area for temporarily storing during processing section data corresponding to fork sections;

branch section column memory area for temporarily storing section data during processing;

embroidery memory area for storing needle location data used to control the sewing machine to form stitches to create the embroidery pattern;

embroidery stitch computing means for computing, based on section data, needle location data for controlling the sewing machine to embroider the closed areas to be embroidered and storing the needle location data in the embroidery memory area;

running stitch computing means for computing, based on section data, needle location data for controlling the sewing machine to form running stitches in the closed area to be embroidered and storing the needle location data in the embroidery memory area;

read-out means for reading out unprocessed section data from the section data memory means starting with the section containing the starting point;

control means for receiving each section data read out by the read-out means and storing the section data in the temporary memory area and the branch section column memory area if the section data represents a fork section, storing the section data in the temporary memory area if the section data does not represent a fork section and the temporary memory area contains fork section data, or sending the section data to the embroidery stitch computing means for computation of needle location data if the section data does not represent a fork section and the temporary memory does not contain section data; wherein the control means directs the running stitch and embroidery computing means to compute needle location data from the section data stored in the branch section column memory means if the read-out means reads out an end section that is not the ending section or if the read-out means reads out section data corresponding to the ending section and the section data memory means does not contain section data for which the embroidery stitch computing means has not computed needle location data.

15. The embroidery pattern data processor of claim 14, in which the control means erases all section data contained in the temporary memory area and in the branch column memory area except the section data first stored in the temporary memory area if the read-out means reads out section data corresponding to an ending section and the section data memory means contains section data for which the embroidery stitch computing means has not computed needle location data.

16. The embroidery pattern data processor of claim 15, in which the fork section data stored in the temporary memory area are consecutively numbered by incrementing a variable from an initial value as the fork section data is stored in the temporary memory area and the control means resets the variable to the initial value when the control means erases section data contained in the branch column memory area.

17. The embroidery pattern data processor of claim 16, in which the control means directs the read-out means to read out section data corresponding to an unprocessed section that is adjacent to the section data first stored in the temporary memory area and, unless only one section data corresponding to a section adjacent to the first stored section data exists for which the embroidery stitch computing means has not computed needle location data, that has not been previously determined to be part of a main section column.

18. An embroidery pattern data processor for generating needle location data for a sewing machine that sews embroidery patterns under control of the needle location data, the needle location data for an embroidery pattern being generated based on a plurality of sections formed by dividing closed areas defined by an outline representing the embroidery pattern to be stitched by the sewing machine, comprising:

memory means for storing section data representing locations of vertexes of polygonal sections dividing the closed areas for embroidering the closed areas;

designation means for designating starting and ending points for each closed area;

determination means for determining, based on the section data stored in the section data memory area, if each section corresponding to the section data is an end section of a main section column between the sections containing the starting and ending points, a fork section from which a branch section column branches out of a main section column, or an end section of a branch section column;

read-out means for successively reading out the section data corresponding to each of the sections of each closed area starting from the section containing the starting point;

running stitch computing means for computing, based on read out section data, running stitch data representing the sewing routes for running stitches, where the running stitch computing means computes running stitches that run through the sections of a given branch section column towards end sections of the given branch section column prior to the embroidering of the fork section from which the branch section column branches out the main section column; and needle location computing means for computing, based on read out section data, needle location data for embroidering the main section columns of the at last one closed area from the section containing the starting point to the section containing the ending point and for embroidering any branch section columns from the end section where running stitches routes end to the fork sections where running stitches routes begin along branch section columns, where the needle location computing means computes needle location data such that the sewing machine embroiders the section containing the ending point after embroidering all other sections of the at least one closed area.

19. The embroidery pattern data processor of claim 18, in which the embroidery pattern contains a plurality of closed areas and the needle location computing means computes needle location data such that the sewing machine forms a stitch from the section containing the ending point of one closed area to the section containing the starting point of the next adjacent, unconnected closed area of the embroidery pattern.

* * * * *